US011780705B2

(12) United States Patent
Kalliomaki et al.

(10) Patent No.: US 11,780,705 B2
(45) Date of Patent: Oct. 10, 2023

(54) METHOD FOR OPERATING AN ELEVATOR

(71) Applicant: Kone Corporation, Helsinki (FI)

(72) Inventors: Jaakko Kalliomaki, Helsinki (FI); Jarkko Saloranta, Helsinki (FI); Mikko Puranen, Helsinki (FI); Sakari Mantyla, Helsinki (FI); Joonas Sorvari, Helsinki (FI)

(73) Assignee: Kone Corporation, Helsinki (FI)

( * ) Notice: Subject to any disclaimer, the term of this patent is extended or adjusted under 35 U.S.C. 154(b) by 393 days.

(21) Appl. No.: 17/138,308

(22) Filed: Dec. 30, 2020

(65) Prior Publication Data

US 2021/0206600 A1 Jul. 8, 2021

(30) Foreign Application Priority Data

Jan. 7, 2020 (EP) ..... 20150526

(51) Int. Cl.
*B66B 5/02* (2006.01)
*B66B 7/06* (2006.01)

(52) U.S. Cl.
CPC ..... *B66B 5/022* (2013.01); *B66B 7/064* (2013.01)

(58) Field of Classification Search
CPC ..... B66B 5/022; B66B 7/064; B66B 5/02; B66B 7/06; B66B 7/068; B66B 1/28; B66B 3/02; B66B 5/0031
See application file for complete search history.

(56) References Cited

U.S. PATENT DOCUMENTS

2014/0069747 A1* 3/2014 Benosman ..... B66B 7/06 187/414
2014/0124300 A1* 5/2014 Benosman ..... B66B 7/06 187/247

(Continued)

FOREIGN PATENT DOCUMENTS

EP 2733103 B1 1/2016
EP 3693315 A1 * 8/2020 ..... B66B 1/06

(Continued)

OTHER PUBLICATIONS

CA Extended European Search Report, dated Jul. 20, 2020.

*Primary Examiner* — Jeffrey Donels
(74) *Attorney, Agent, or Firm* — Harness, Dickey & Pierce, P.L.C.

(57) ABSTRACT

The invention relates to a method for operating an elevator installed in connection with a building, particularly a high rise elevator, in which method the expected rope sway is monitored using building acceleration data obtained by means of a sensor to calculate a building sway, and whereby based on the building sway and the position of an elevator car a rope sway is estimated, which rope sway is compared with a threshold value to determine the amount of rope sway and to deduct operation measures for the elevator based on the amount of the rope sway, characterized by the succession of following steps determining elevator car position determining change of rope sway based on the car position and the building acceleration data if it is concluded that rope sway is not increasing, then calculating the number of rope sway cycles n(zca,) within a building sway period Tbuilding and (Continued)

calculating a new (decreasing) rope sway amplitude x based on said number of rope sway cycles n(zca,) and a damping factor I.

12 Claims, 3 Drawing Sheets

(56) References Cited

U.S. PATENT DOCUMENTS

| | | | | |
|---|---|---|---|---|
| 2018/0265327 | A1* | 9/2018 | Benosman | B66B 7/06 |
| 2020/0239274 | A1* | 7/2020 | Gurvich | B66B 1/3476 |
| 2020/0255260 | A1* | 8/2020 | Roberts | B66B 5/022 |
| 2021/0206597 | A1* | 7/2021 | Kalliomaki | B66B 5/02 |
| 2022/0371858 | A1* | 11/2022 | Asamura | B66B 11/08 |
| 2022/0381317 | A1* | 12/2022 | Asamura | F16F 15/02 |

FOREIGN PATENT DOCUMENTS

| | | | |
|---|---|---|---|
| JP | 2009-214988 | A | 9/2009 |
| JP | 5704700 | B2 * | 4/2015 |

* cited by examiner

METHOD FOR OPERATING AN ELEVATOR

RELATED APPLICATIONS

This application claims priority to European Patent Application No. 20150526.0 filed on Jan. 7, 2020, the entire contents of which are incorporated herein by reference.

TECHNICAL FIELD

The present invention relates to a method for operating an elevator installed in connection with a building, particularly a high rise elevator. These elevators, especially in high buildings such as skyscrapers, may be exposed to building sway, caused by strong wind or seismic waves. Building sway may invoke rope sway. A rope sway may be excessive, especially if the natural frequency of the rope matches the frequency of the building sway. An excessive rope sway is dangerous, as it may cause ropes hitting the hoistway devices.

BACKGROUND

On this behalf elevators are equipped with at least one building sway sensor, such as an acceleration sensor. When a given amount of building sway is measured the elevator operation is interrupted. By this way any dangerous situation of excessive rope sway may be prevented. However, the elevator operation may be interrupted also in potentially harmless situations, causing unnecessary interruptions to elevator service.

The Publication EP 2 733 103 B1 discloses a solution wherein rope sway is estimated by means of precalculated tables, based on the current position of a running elevator car and the building acceleration (shake). The elevator operation is interrupted only if the estimated rope sway exceeds a given threshold value. With this solution the elevator operation has to be interrupted only in selected situations, on the basis of the estimation result, which improves elevator service.

SUMMARY

It is object of the present invention to provide a method which is able to counteract excessive rope sway in an earlier stage and to improve elevator ride comfort in rope sway situation.

The object is solved with a method according to claim 1. Preferred embodiments of the invention are subject-matter of the corresponding dependent claims. Preferred embodiments are also described in the specification of the application.

In the inventive method for operating an elevator installed in connection with a building, particularly a high rise elevator, the expected rope sway is monitored using building acceleration data obtained by means of at least one sensor to calculate a building sway. Based on the building sway and the position of an elevator car a rope sway is estimated. The estimated rope sway is compared with at least one threshold value to determine excessive rope sway and to deduct operation measures for the elevator in order to counteract a determined excessive rope sway.

According to the invention the expected rope sway is monitored using building acceleration data obtained by means of a sensor to calculate a building sway. Based on the building sway and the position of an elevator car a rope sway is estimated, which rope sway is compared with a threshold value to determine the amount of rope sway and to deduct operation measures for the elevator based on the amount of the rope sway. According to the invention, first the current elevator car position is determined or predicted. Thereafter change of rope sway is determined based on the car position and the building acceleration data. If it is concluded that rope sway is not increasing, then the number of rope sway cycles $n(z_{car})$ within a preselected constant time period is calculated and a new (decreasing) rope sway amplitude x is calculated based on said number of rope sway cycles $n(z_{car})$ and a damping factor $\zeta$.

According to the invention, the preselected constant time period may be within the range of 1 s-15.

Preferably, the preselected constant time period is the building sway period $T_{building}$.

This method allows it to control the elevator to best cope with moderate building sway as to improve the passenger comfort. The method is able to determine any conditions which might lead to an uncomfortable experience of the passengers. The operation measures are intended to increase the passenger comfort in a non-critical sway situation. These operation measures thus comprise "soft" interference with the elevator operation that should go unnoticed by the passengers. These operation measures may thus comprise a change the car speed and/or car acceleration, the change of the stopping time of the elevator car at one or more stopping floors or even a temporary exclusion of stopping floors from service which stops then might lead to uncomfortable ride experience of the passengers afterwards. All these measures lead to a smooth operation in moderate sway conditions under maintaining a high ride comfort.

Preferably, in one embodiment of the invention data tables are calculated already beforehand by means of a virtual model of the elevator. These data tables include, for different building accelerations, time series of calculated amounts of rope sway as a function of the elevator car position. The data tables include time series for amounts of rope sway in a particular car position, for example: increase of rope sway after one building sway period T, after two sway periods 2T, and so on. Thereafter, the current amount of sway $S_0$, e.g. the measured value or last calculated or predicted value etc. is compared to the highest value of sway $S_{max}$ in the data table, and if the current value of sway $S_0$ has reached $S_{max}$ it is determined that the sway does not increase. In that case calculation routine changes to the method of the present invention, i.e. to use a damping model, calculating the decrease of rope sway as disclosed above and in claim 1.

Otherwise, if $S_0<S_{max}$, it is determined that the rope sway is still increasing, and "amplification model" is used for calculation. In that case, by using the correct data table, which table is selected based on measured building acceleration, the current sway amplitude $S_0$ or a closest value of it in the table is selected, and then increase of rope sway dS is determined from the table, from the selected table value onwards. Then amount of rope sway after one building shape period ST will be: ST=S0+dS. According to this value eventually correcting steps are taken if the future rope sway becomes non-desired. These corrective steps could comprise the immediate stop of the car or stop at the nearest landing to release the passengers.

According to a preferred embodiment of the invention, a movement profile for the elevator car is established by means of an elevator controller. Based on this movement profile, the car position of the elevator car is predicted. The estimated rope sway is now calculated based on the predicted car position and the building acceleration data and not on the current car position as in the known solution of EP 2

733 103 B1. The advantage of the inventive solution is that it is possible to calculate excessive rope sway already before the elevator car has assumed the position which is predicted as the position of the excessive rope sway. This again allows to take countermeasures before the elevator car reaches the critical position which is correlated with the excessive rope sway. This way it may be possible to improve elevator ride comfort in rope sway situation and/or improve elevator safety.

In a preferred embodiment of the invention, a virtual model of the elevator is used to calculate the rope sway based on the measured building acceleration and the predicted elevator car position. The virtual model of the elevator comprises the critical parameters of the elevator such as the car path, counterweight path, rope length and position of the elevator shaft in the building. Further it comprises physical properties like elevator load, counterweight, weight, damping parameters and so on. Thus, by using the virtual model it is possible to calculate the rope sway based on the acceleration sensor data and the predicted car position. In a preferred embodiment virtual model is used for said calculation already during the engineering phase. In this case, by means of the virtual elevator, rope sway amplification data tables are calculated. These data tables are further memorized in rope sway control system. By means of the virtual model, it is also possible to solve problematic situations already beforehand in a detailed manner. Thus, right from the start when building sway situation is determined, it may be possible to lock one or more portions of hoistway from elevator travel and/or to set reduced speed operation for elevator car(s) in one or more portions of hoistway, for example. As a consequence, it may be also possible to forecast passenger transport capacity in rope sway situation.

In a preferred embodiment of the invention for the estimation of the rope sway the prediction of the elevator car position half the building sway period ahead is used to get an early estimation of the corresponding rope sway situation. This enables the taking of countermeasures to the excessive rope sway beforehand.

In a preferred embodiment the prediction of the elevator car position more than half the building sway period ahead is used for the estimation of the rope sway to get a very early estimation of the corresponding rope sway situation. In this situation the very early estimation of the rope sway is preferably verified with at least one consecutive estimation of the rope sway performed after the run of the elevator car. This very early rope sway may not be accurate as one which is performed for example half the building sway beforehand but it still gives more time to predict an excessive rope sway situation and take countermeasures against it. In this case, it is advantageous if the very early estimate of the rope sway is verified with the car position prediction value calculated half the building sway period ahead of the current situation.

If excessive rope sway is determined, there are several possibilities to proceed. It is possible to modify the elevator car motion profile such that the car will avoid non-desired locations in the shaft or pass them as soon as possible. It is also possible to decelerate and stop the car at the closest possible landing to release the elevator passengers. Alternately if the determination of excessive rope sway was based on an early estimate, it may even possible to cancel elevator trips with potentially compromised ride comfort. Alternately or additionally, it may be possible to perform active measures against the rope sway such as operating one or more suitable actuators such as a retractable rope sway limitation device to prevent the consequences of the excessive rope sway or to act against the excessive rope sway.

According to a preferred embodiment, if excessive rope sway is determined, the elevator car speed is decreased. This means that that elevator trip is still continued to the original destination, but with reduced speed. By this measure it may be possible to reduce car vibration caused by rope sway. Thus, elevator ride comfort may be improved in rope sway situation.

According to a preferred embodiment, the elevator controller is configured to operate an actuator depending on the comparison result of the estimated rope sway with the threshold value. The actuator may actively interact with the ropes to decrease rope sway.

According to an embodiment, the actuator is a retractable rope sway limitation device, particularly at least one retractable damper arm. This kind of actuator is preferably used in very high buildings, e.g. in at least 500 meter high buildings.

In a preferred embodiment of the invention, the actual rope displacement is detected and the rope amplitude from the rope sway estimation is amended to match the current situation. By this measure, the virtual or estimated predictions can be brought to coincide with the actual situation which allows the prediction to be amended according to reality. This is a good means to monitor the quality of the prediction and to bring the prediction into better coincidence with the real situation.

The inventive method is intended to be applied to an elevator which is able to perform the above-mentioned method. This elevator comprises an elevator controller which is configured to predict a movement profile of the elevator car, a building acceleration sensor as well as a rope sway estimation unit to calculate an estimated rope sway based on the predicted elevator position data obtained from the predicted movement profile and the signal from the building acceleration sensor. Such an elevator is able to predict excessive rope sway already before the elevator car reaches the position in which the excessive rope sway happens. Thus, the building sway or acceleration is measured with a sensor and additionally the motion profile of the elevator is determined with the elevator controller for the elevator car from the departure floor to its arrival floor. A time-dependent elevator car position prediction is then retrieved from the motion profile established by the elevator controller. It is of course possible that the motion profile is not established by the elevator controller itself but by a separate module or cloud server or the like connected to it.

Preferably, the rope sway is determined by means of a simulator or virtual elevator based on the measured building acceleration, for example the building shake, and the elevator car position prediction from the motion profile. In one embodiment the simulation can take place already during manufacturing phase of the elevator, and the simulation results may be memorized in a table, which is then used for real-time rope sway monitoring. In an alternative embodiment, real-time simulation may be used for rope sway monitoring. If an excessive rope sway amplitude is determined, the elevator is then able to take safety measures. The inventive elevator allows the earlier determination of non-desired rope sway amplitudes. The elevator operation can then be limited when the predictive rope sway amplitudes exceed a given threshold. Of course, the virtual elevator model does not only comprise the physical properties of the elevator and building parameters but also damping models of the whole elevator system, particularly of the roping. Therefore, the virtual elevator model comprises a damping model which discloses in detail the damping coefficients of the ropes. This model is thus adapted to consider the predicted time-dependent elevator car position which improves the rope sway estimation accuracy.

According to a preferred embodiment, the elevator may comprise one or more sensors, such as a rope displacement sensor and/or a car position sensor. Said one or more sensors may be connected with the elevator controller. The virtual elevator may be operated in a remote server, which may be communicatively connected to elevator controller and/or rope sway estimation unit. The simulation model (e.g. parameters of the simulation model) of the virtual elevator may preferably be updated/corrected by means of measurement data from said one or more sensors, so that the model can be better be brought in line with the real elevator system conditions.

A simulator or virtual model may be implemented remote from the elevator controller, even connected via a network for example as a remote cloud computer or server which communicates with the elevator controller. Thus, the present invention provides further improvement for the elevator service and elevator safety in rope sway situations. By means of the invention it is possible to advance the decision process of the rope sway monitoring so that the elevator service interruptions can be minimized and alternative courses of action may be taken instead, if necessary. Accordingly, with the inventive method or elevator, the elevator service and availability are improved without compromising the elevator safety.

Generally, the building sway period or natural period of building is a function of the building height. Typically the building sway period can be somewhere between 2 to 8 seconds for building height from 100 to 350 meters.

Following terms are used as synonyms: excessive rope sway—rope sway amplitudes exceeding a threshold value—non-desired rope sway amplitude; simulator—virtual elevator—elevator model—simulation computer;

It is apparent for the skilled person that the above-mentioned embodiments may be combined with each other arbitrarily.

BRIEF DESCRIPTION OF THE DRAWINGS

Hereinafter, the invention is described by the aid of the enclosed drawings in which.

DETAILED DESCRIPTION

Figure 1:
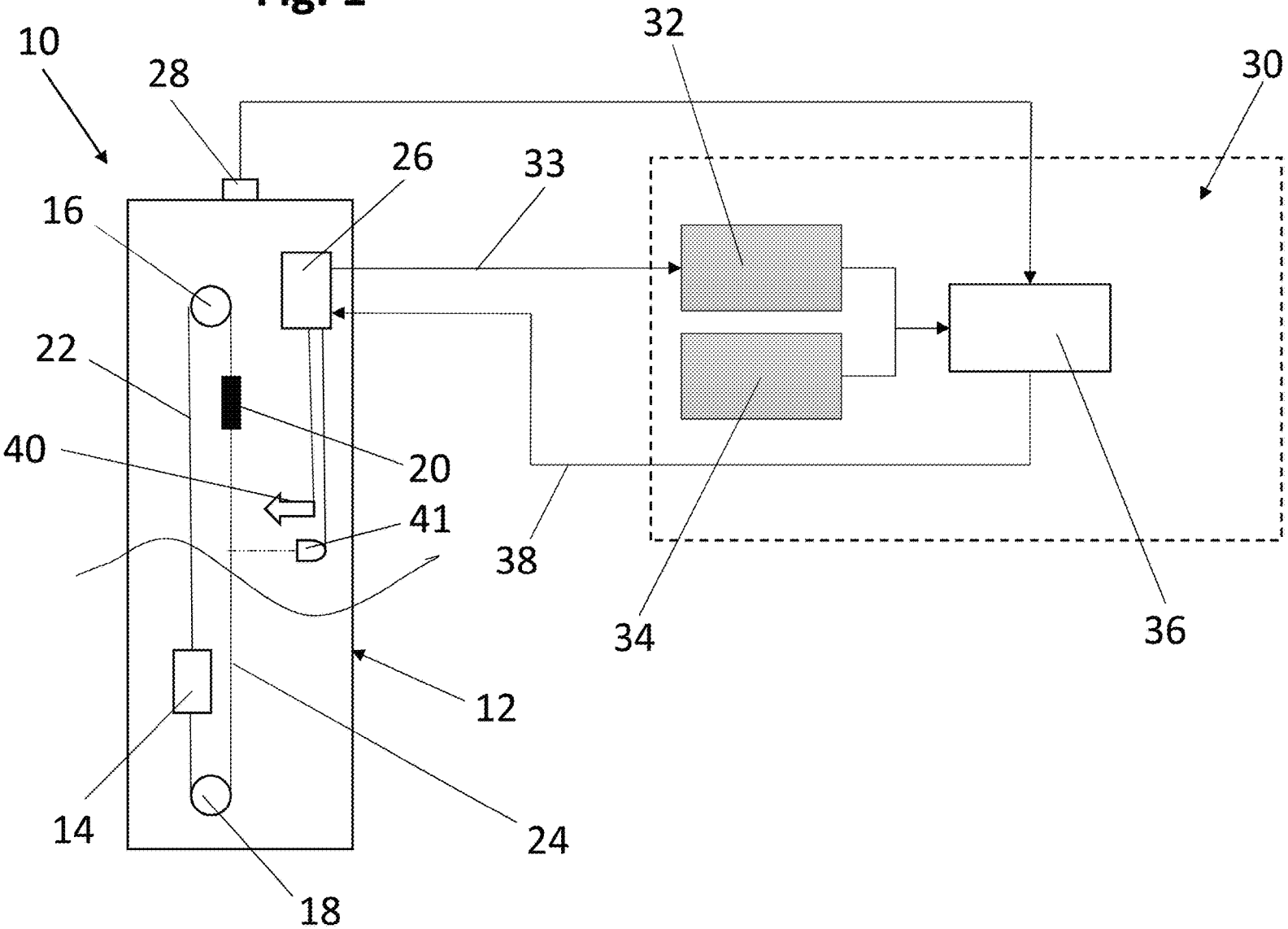
FIG. 1 shows a flow-chart of the inventive elevator.

FIG. 1 shows an elevator 10 comprised in a building having an elevator shaft 12. The building is particularly a high rise building as for example a skyscraper and correspondingly, the elevator shaft 12 is a very long shaft of a high rise elevator. In the elevator shaft 12, an elevator car 14 and a counterweight 20 with their top are connected via upper suspension ropes 22 running over an upper traction sheave 16. Further the elevator car 14 and the counterweight 20 are with their bottom connected via lower compensation ropes 24 running over a lower compensation sheave 18. The car 14 and counterweight 20 are moved via the suspension ropes which are in friction co-action with the traction sheave which is connected to the output shaft of an elevator motor.

The elevator 10 has an elevator controller 26 controlling elevator motor 16 and thus the movement of the elevator car 14. Further the elevator 10 comprises call input means, e.g. destination call panels in the lobby and on the floors for the input of a destination floor or driving direction. The elevator controller also comprises a car allocation model, which allocates a given call to an elevator under consideration of pre-determined optimisation criteria as e.g. passenger waiting time, passenger driving time, total ride time, energy consumption etc.

Connected with the building is a building acceleration sensor 28 which measures any acceleration acting on the building, e.g. caused by seismic activity or wind pressure. The elevator controller 26 is connected with a rope sway control system 30 which may be part of the elevator controller 26 or may be located apart from it whereby even a location in a cloud server is possible.

The sway control system 30 comprises an elevator position prediction module 32. The elevator position prediction module 32 comprises motion profiles for the elevator car for all possible allocation situations. Thus the module 32 can predict from the current allocation situation and from the current elevator car position and/or movement data the motion profile of the car position over the time on its travel between departure floor and the final destination floor. The allocation based travel data and the current position/movement of the elevator car are obtained from the elevator controller 26 via the input line 34.

In the a first embodiment where rope sway situations are already calculated beforehand by means of a virtual model in the engineering phase, precalculated amplification data tables are used for real-time rope sway amplitude calculation. These data tables are calculated beforehand by means of simulator.

In a second alternative embodiment, the rope sway control system 30 further comprises a simulator of the elevator system. The simulator comprises all physical parameters of the elevator of its roping and all the damping parameters correlated to it. The heart of the rope sway control system 30 of both the first and the second embodiment is a real-time rope sway calculation unit 36 which gets the predicted car position data from the elevator position prediction unit 32. In the first embodiment, said data tables are used; in the second alternative embodiment the simulator is used for calculating the complete physical data.

Via the movement profile established by the elevator position prediction unit 32 and physical data of the elevator from the simulator/the data tables, the real-time rope sway calculation unit can—together with the data from the acceleration sensor 28—calculate the rope sway which is going to happen along the whole journey of the elevator car along its path in the elevator shaft 12. The rope sway amplitudes are then calculated considering the predicted car position on its way, and the current building sway measured by the sensor 28. If the rope sway amplitudes which will occur along the predicted positions of the elevator car exceed at least one threshold value, this means that an excessive rope sway amplitude will be expected along the travel of the elevator car, normally at a certain position of the elevator car, at which the natural sway frequency of the free length of the suspension ropes 22 and compensation ropes 24 build up with the building sway frequency. In this case a signal is outputted via the output line 38 back to the elevator controller 26 which is either able to modify or cancel the elevator travel itself.

Optionally, the signal may operate a rope sway limitation device 40, for example a roller touching the elevator rope to suppress the rope sway which is retractable after the critical position has been passed by the elevator car.

Optionally, the elevator further comprises at least one rope displacement sensor 41 which may be an optical sensor. This rope displacement sensor 41 allows the verification of the estimated rope sway data with the actual rope sway to verify and adapt the estimated data which leads to a better accuracy of the prediction.

Of course the rope sway control system 30 and/or all components 32, 34, 36 thereof may be part of the elevator controller or being located in separate modules connected with the elevator controller 26 via a data connection.

In summary, the inventive method and the inventive elevator as shown in FIG. 1 is able to predict non-desired rope sway conditions in good time before they really happen, in good time before the elevator really assumes the non-desired position. Thus, the elevator controller 26 is able to take countermeasures in good time beforehand to avoid these non-desired situations or to act against them.

Figure 2:
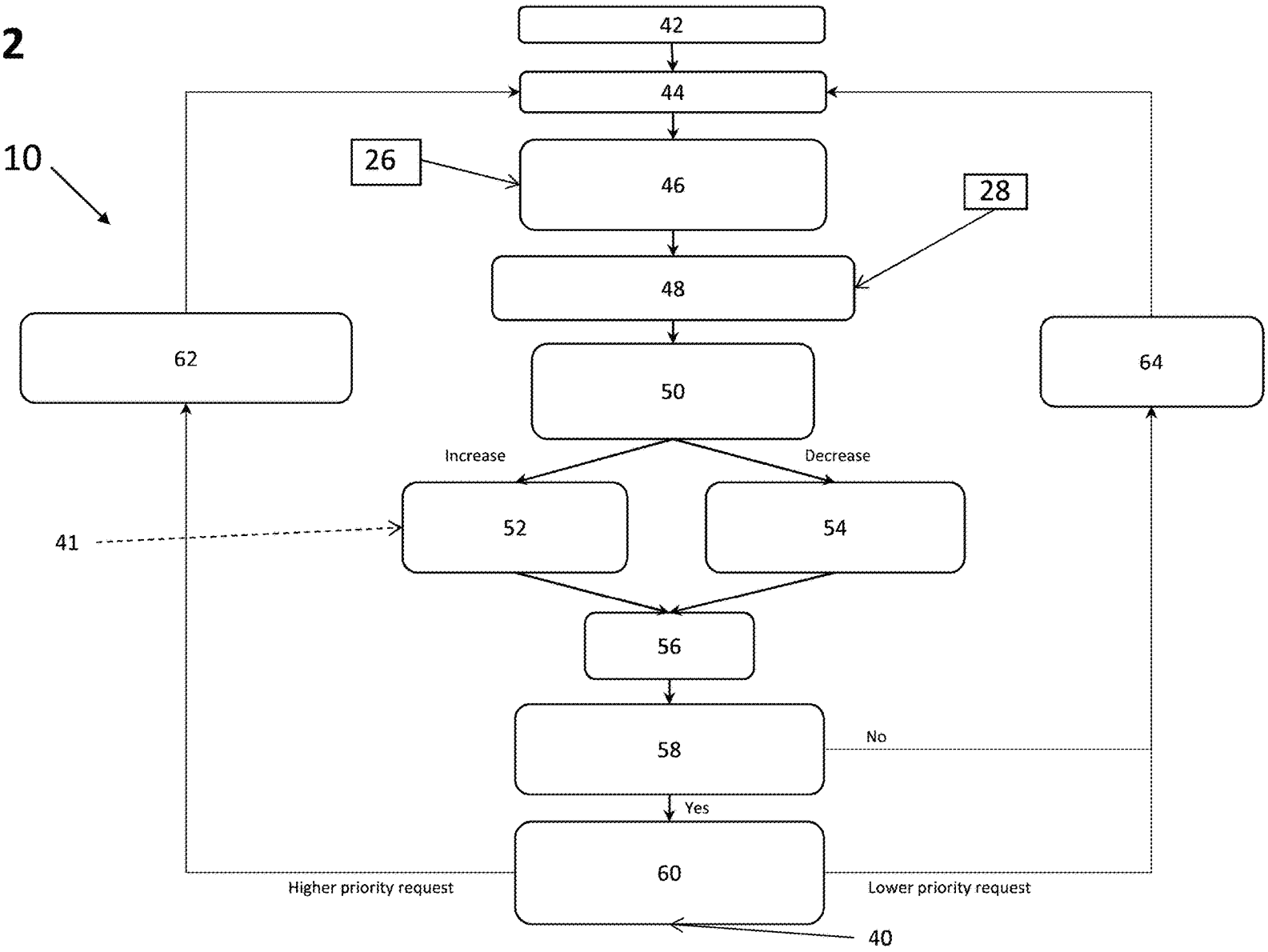
FIG. 2 shows a method flow diagram of the inventive method.

FIG. 2 shows a method flow-chart of the rope sway monitoring of an elevator during a car travel. With the input of an elevator call and the subsequent allocation of an elevator, the elevator journey is via the elevator position prediction module known to the rope sway calculation unit 36 which performs the method of FIG. 2. The calculation routine starts at 42 and progresses to step 44 in which a calculation period is updated. In the embodiment of FIG. 2, the calculation period is selected to meet the building sway period, but the calculation period could also be selected differently. Building sway period may a constant given by the builder. In step 46 the motion profile from the elevator controller is obtained and the position of the elevator car in the middle of the building sway period is predicted. Further in step 48 the effective building acceleration for the current building sway period is calculated, using the current signal of the building acceleration detector 28. In step 50 it is based on the data tables 34 (first embodiment) or the simulator data 34 (second embodiment) determined whether the current rope amplitude still increases or has already reached a maximum.

If the rope amplitude increases the process branches to step 52, in which the current rope sway amplitude increase is determined. The rope sway is calculated in step 52 with a first calculation method using an amplification model (e.g. the data tables).

Otherwise a decrease of the rope sway is calculated in step 54 with a second calculation method using a damping model. Use of the damping model is explained as follows.

Decrement of rope sway takes place in logarithmic manner. In real-time rope amplitude calculation, the calculation time step is equal to building sway period $T_{building}$ (a constant, usually given by the builder). The elevator rope segment period $T_{rope}$ however is a function of car position $z_{car}$ in the shaft. The following relation is defined, that gives the number of rope sway cycles n within one building sway cycle.

$$n(z_{car}) = \frac{T_{building}}{T_{rope}(z_{car})} \tag{1}$$

In other words, $n(z_{car})$ is a function of elevator car position. The rope segment period $T_{rope}$ values are calculated a-priori for different car locations and different rope segments, using the simulator. The values are stored in an array that is used during real-time amplitude calculation. The rope segment period $T_{rope}$ used in the calculation corresponds to the first natural mode of the rope segment.

So the value of the elevator rope segment sway amplitude x (i.e., the value of the exponential decay envelope) after one building cycle is calculated as $$x(t_0+T_{building})=x(t_0)\cdot e^{-2\pi n\zeta} \tag{2}$$

In (2), $\zeta$ is a damping factor, which may be a predefined constant, which may be selected when data tables 34 are calculated. Alternatively, damping factor $\zeta$ may be defined as a function of elevator car position and concurrent rope sway amplitude.

The use of equations (1) and (2) enables fast and reliable real-time calculation of rope sway in damping situation.

Both steps 52 as well as 54 branch back to step 56 wherein the rope sway value corresponding to the middle of the current period is updated based on steps 52 or 54. Afterwards the method proceeds to decision step 58, wherein it is checked whether the updated rope sway values necessitates protective measures. If no, the process branches to step 64 in which it is waited until the end of the building sway period and then branches back to step 44. If yes, in step 60 any current active sway protection method is verified, e.g. by reading the operating status of the rope sway limitation device 40 from the elevator controller 26. Afterwards a differentiation is made depending on the priority of the situation, i.e. depending on the value of any sudden increase of building sway, e.g. after an earth quake. In case of a high priority protective measures are immediately taken in step 62. These measures include any changes on the car path to avoid the non-desired situation and/or the activation of rope sway limitation devices and/or a stop of the elevator operation after releasing the passengers e.g. at the nearest landing. The process then waits till the end of the building sway period and branches back to step 44.

If the priority is lower it is branched from step 60 to step 64 where it is waited until the end of the building sway periods and then it branches back to step 44.

This process ensures a reasonable adapted response to any non-desired sway conditions in advance, which allows safety measures, as e.g. the release of passengers already at an early stage before the non-desired situation is going to take place.

Figure 3:
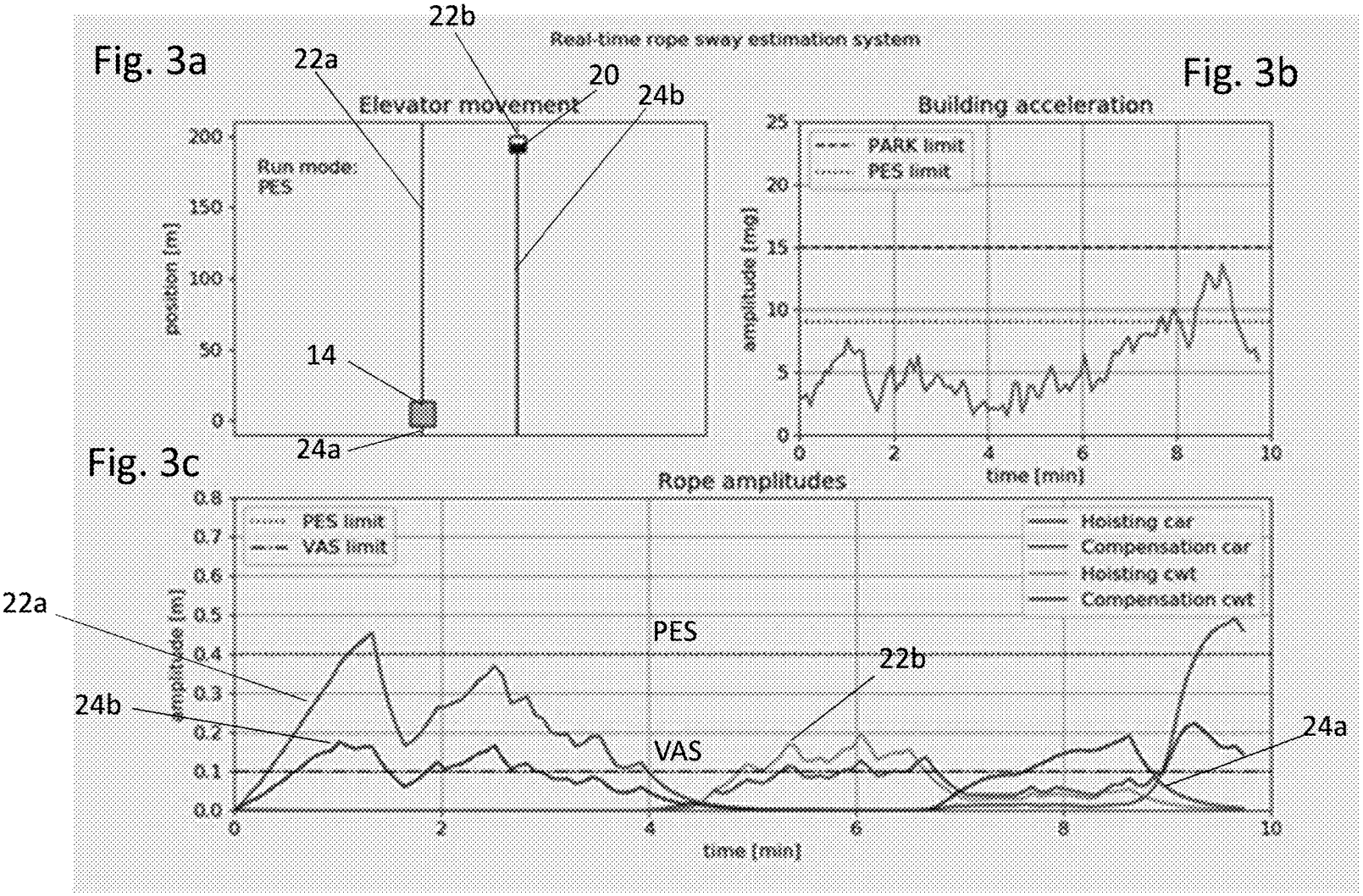
FIG. 3 shows examples of building acceleration and rope sway amplitudes.

FIG. 3 shows schematically the function of the rope sway control system 30 of FIG. 1 by means of an example.

In FIG. 3 FIG. 3*a* shows a very schematic illustration of a predicted car position in an elevator shaft with a length of 200 m. 22*a* is the suspension rope between car 14 and traction sheave 16, while 22*b* designates the suspension rope part between the traction sheave 16 and the counter weight 20. Accordingly, 24*a* designates the compensation rope part between the car 14 and the compensation sheave 18, while 24*b* designates the compensation rope part between the compensation sheave 18 and the counter weight 20. The predicted situation is sensible for excessive rope sway as the car suspension rope 22*a* as well as the counterweight compensation rope 24*b* extend feely nearly along the whole shaft length.

FIG. 3*b* shows a current signal of a building acceleration sensor 28 for the building in which the elevator 10 is installed.

FIG. 3*c* shows the amplitudes of rope sway for the different suspension and compensation rope parts 22*a,b* and 24*a,b* calculated by the rope sway control system 30 for the predicted car and counterweight positions according to FIG. 3*a*. The system comprises several limits for the rope sway amplitudes which lead to certain measures, if exceeded.

The lowest amplitude limit is the VAS limit. VAS means "Variable speed selection" which means that the exceeding of this limit leads to running the elevator slower than normal when elevator approaches a terminal landing.

The next higher limit is the PES limit, where by PES stands for "Performance selection". The passing of this limit by the estimated rope sway amplitudes leads to the running of the elevator with reduced speed, i.e. half speed not only when approaching a terminal landing.

The highest limit which is only shown in FIG. 3*b* is the PARK limit. Exceeding this limit leads to an immediate parking of the elevator car at a safe (non-resonant) floor during extreme sway conditions.

Thus, the elevator is well adapted to handle in advance any situations with respect to the building which may lead to non-desired rope sway conditions, as e.g. earth quakes, strong wind, objects hitting the building etc.

The invention is not delimited to the enclosed embodiments but it can be varied within the scope of the following patent claims.

LIST OF REFERENCE NUMBERS

10 elevator
12 elevator shaft
14 elevator car
16 traction sheave
18 compensation sheave
20 counter weight
22 suspension ropes
24 compensation ropes
26 elevator controller
28 building acceleration (sway) sensor
30 rope sway control system
32 elevator position prediction module
34 input line from the elevator controller to the rope sway control system
36 rope sway calculation unit
38 output line from the rope sway control system to the elevator controller
40 rope sway limitation device
41 (real-time) rope displacement sensor
42-64 process steps of the rope sway calculation routine

The invention claimed is:

1. A method for operating an elevator installed in connection with a building, the method comprising:

determining an elevator car position of an elevator car in the elevator;

determining a rope sway amplitude of a rope sway of a rope coupled to the elevator car based on the elevator car position and a building sway of the building, the building sway determined based on building acceleration data obtained from a building acceleration sensor of the building;

determining whether the rope sway is increasing based on the determined rope sway amplitude;

in response to a determination that the rope sway is not increasing, calculating a number of rope sway cycles $n(Z_{car})$ of the rope sway within a constant time period, and calculating a new decreased rope sway amplitude x of the rope sway based on the number of rope sway cycles $n(Z_{car})$ and a damping factor $\zeta$; and controlling an operation of the elevator based on a comparison of the new decreased rope sway amplitude x with a threshold value.

2. The method of claim 1, wherein the constant time period is a building sway period $T_{building}$.

3. The method claim 2, wherein the number of rope sway cycles $n(Z_{car})$ within the building sway period $T_{building}$ is calculated according to Equation 1:

$$n(z_{car}) = \frac{T_{building}}{T_{rope}(z_{car})} \quad \text{[Equation 1]}$$

wherein, in Equation 1, $T_{rope}$ is an elevator rope segment period, and $Z_{car}$ is the elevator car position.

4. The method of claim 3, wherein the new decreased rope sway amplitude x is calculated according to Equation 2:

$$x(t_0+T_{building})=x(t_0)\cdot e^{-2\pi n\zeta} \quad \text{[Equation 2]}$$

wherein, in Equation 2, $x(t_0)$ is the determined rope sway amplitude, $x(t_0+T_{building})$ is the new decreased rope sway amplitude x, and n is the number of rope sway cycles $n(Z_{car})$ within the building sway period $T_{building}$.

5. The method of claim 1, wherein the controlling the operation of the elevator includes changing a car speed of the elevator car.

6. The method of claim 1, wherein the controlling the operation of the elevator includes changing a floor stopping time of the elevator car.

7. The method of claim 1, wherein the controlling the operation of the elevator includes temporarily excluding one or more landing floors of the elevator from service.

8. An elevator configured to be installed in a building, the elevator comprising:

an elevator car and a counterweight in an elevator shaft, the elevator car and the counterweight connected via one or more ropes, at least one rope of the one or more ropes extending over a sheave;

an elevator motor configured to drive the sheave to cause the elevator car and the counterweight to move in the elevator shaft; and an elevator controller configured to control an operation of the elevator based on a result of a comparison of a particular rope sway amplitude of a rope sway of a rope of the one or more ropes with a threshold value, wherein the particular rope sway amplitude is determined based on determining an elevator car position of the elevator car in the elevator, determining a rope sway amplitude of the rope sway based on the elevator car position and a building sway of the building, the building sway determined based on building acceleration data obtained from a building acceleration sensor of the building, determining whether the rope sway is increasing based on the determined rope sway amplitude, and in response to a determination that the rope sway is not increasing, calculating a number of rope sway cycles $n(Z_{car})$ of the rope sway within a constant time period, and calculating the particular rope sway amplitude as a new decreased rope sway amplitude x of the rope sway based on the number of rope sway cycles $n(Z_{car})$ and a damping factor.

9. The elevator of claim 8, wherein the elevator controller is configured to selectively control the operation of the elevator based on changing a car speed of the elevator car.

10. The elevator of claim 8, wherein the elevator controller is configured to selectively control the operation of the elevator based on changing a floor stopping time of the elevator car.

11. The elevator of claim 8, wherein the elevator controller is configured to selectively control the operation of the elevator based on temporarily excluding one or more landing floors of the elevator from service.

12. The elevator of claim 8, wherein the elevator controller is connected with a rope sway control system that is external to the elevator controller, the rope sway control system configured to determine the particular rope sway amplitude, perform the comparison of the particular rope sway amplitude with the threshold value, and transmit a signal to the elevator controller to cause the elevator controller to control the operation of the elevator based on the result of the comparison of the particular rope sway amplitude with the threshold value.

* * * * *